US007506511B2

(12) United States Patent
Zupanc et al.

(10) Patent No.: US 7,506,511 B2
(45) Date of Patent: Mar. 24, 2009

(54) REDUCED EXHAUST EMISSIONS GAS TURBINE ENGINE COMBUSTOR

(75) Inventors: Frank J. Zupanc, Phoenix, AZ (US); Paul R. Yankowich, Phoenix, AZ (US); Michael T. Barton, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 816 days.

(21) Appl. No.: 10/746,654

(22) Filed: Dec. 23, 2003

(65) Prior Publication Data

US 2005/0132716 A1 Jun. 23, 2005

(51) Int. Cl.
*F02C 1/00* (2006.01)
*F02G 3/00* (2006.01)

(52) U.S. Cl. ..... 60/746; 60/748

(58) Field of Classification Search ..... 60/733, 60/734, 739, 740, 746, 747, 748
See application file for complete search history.

(56) References Cited

U.S. PATENT DOCUMENTS

| | | | | | |
|---|---|---|---|---|---|
| 3,714,778 | A | | 2/1973 | Howald | |
| 4,194,358 | A | * | 3/1980 | Stenger | 60/776 |
| 4,305,255 | A | * | 12/1981 | Davies et al. | 60/741 |
| 4,817,389 | A | | 4/1989 | Holladay et al. | |
| 4,991,398 | A | | 2/1991 | Clark et al. | |
| 5,081,844 | A | * | 1/1992 | Keller et al. | 60/737 |
| 5,154,060 | A | * | 10/1992 | Walker et al. | 60/746 |
| 5,197,278 | A | * | 3/1993 | Sabla et al. | 60/773 |
| 5,235,814 | A | * | 8/1993 | Leonard | 60/738 |
| 5,237,820 | A | * | 8/1993 | Kastl et al. | 60/752 |
| 5,285,635 | A | * | 2/1994 | Savelli et al. | 60/804 |
| 5,289,685 | A | * | 3/1994 | Hoffa | 60/739 |
| 5,321,951 | A | * | 6/1994 | Falls et al. | 60/748 |
| 5,331,814 | A | * | 7/1994 | Sandelis | 60/747 |
| 5,402,634 | A | * | 4/1995 | Marshall | 60/776 |
| 5,417,069 | A | * | 5/1995 | Alary et al. | 60/747 |
| 5,479,772 | A | * | 1/1996 | Halila | 60/800 |
| 5,596,873 | A | | 1/1997 | Joshi et al. | |
| 5,884,483 | A | * | 3/1999 | Munro | 60/739 |
| 5,916,142 | A | * | 6/1999 | Snyder et al. | 60/748 |
| 6,058,710 | A | * | 5/2000 | Brehm | 60/747 |
| 6,212,870 | B1 | * | 4/2001 | Thompson et al. | 60/772 |
| 6,345,505 | B1 | * | 2/2002 | Green | 60/748 |
| 6,360,525 | B1 | * | 3/2002 | Senior et al. | 60/776 |
| 6,370,863 | B2 | * | 4/2002 | Muller et al. | 60/776 |
| 6,550,251 | B1 | * | 4/2003 | Stickles et al. | 60/776 |
| 6,609,377 | B2 | * | 8/2003 | Durbin et al. | 60/748 |
| 6,691,518 | B2 | * | 2/2004 | Doebbeling et al. | 60/776 |
| 6,708,498 | B2 | * | 3/2004 | Stickles et al. | 60/776 |
| 6,857,272 | B2 | * | 2/2005 | Summerfield et al. | 60/739 |
| 6,945,053 | B2 | * | 9/2005 | Von Der Bank | 60/776 |

(Continued)

*Primary Examiner*—William H Rodríguez
(74) *Attorney, Agent, or Firm*—Ingrassia Fisher & Lorenz, P.C.

(57) ABSTRACT

A gas turbine engine combustor includes a plurality of main fuel injector assemblies, and a plurality of pilot fuel injector assemblies, that are arranged and configured to reduce exhaust gas emissions during engine operation. The plurality of main fuel injector assemblies are arranged in a substantially circular pattern of a first radius, and each includes an outlet port having a first divergence angle. The plurality of pilot fuel injector assemblies are arranged in a substantially circular pattern of a second radius. Each pilot fuel injector assembly is disposed between at least two main fuel injector assemblies, and each includes an outlet port having a second divergence angle.

12 Claims, 4 Drawing Sheets

U.S. PATENT DOCUMENTS 6,968,699 B2 * 11/2005 Howell et al. ..... 60/776
6,983,599 B2 * 1/2006 Young et al. ..... 60/722
7,155,913 B2 * 1/2007 Beule et al. ..... 60/804
2007/0113557 A1 * 5/2007 Schumacher et al. ..... 60/751

* cited by examiner

REDUCED EXHAUST EMISSIONS GAS TURBINE ENGINE COMBUSTOR

STATEMENT REGARDING FEDERALLY SPONSORED RESEARCH OR DEVELOPMENT

This invention was made with Government support under contract number NAS301136, awarded by the N.A.S.A. The Government has certain rights in this invention.

FIELD OF THE INVENTION

The present invention relates to gas turbine engines and, more particularly, to a gas turbine engine combustor that has reduced pollutant exhaust gas emissions.

BACKGROUND OF THE INVENTION

A gas turbine engine may be used to power various types of vehicles and systems. A particular type of gas turbine engine that may be used to power aircraft is a turbofan gas turbine engine. A turbofan gas turbine engine may include, for example, five major sections, a fan section, a compressor section, a combustor section, a turbine section, and an exhaust section. The fan section is positioned at the front, or "inlet" section of the engine, and includes a fan that induces air from the surrounding environment into the engine, and accelerates a fraction of this air toward the compressor section. The remaining fraction of air induced into the fan section is accelerated into and through a bypass plenum, and out the exhaust section.

The compressor section raises the pressure of the air it receives from the fan section to a relatively high level. In a multi-spool engine, the compressor section may include two or more compressors. For example, in a triple spool engine, the compressor section may include a high pressure compressor, and an intermediate compressor. The compressed air from the compressor section then enters the combustor section, where a ring of fuel nozzles injects a steady stream of fuel. The injected fuel is ignited by a burner, which significantly increases the energy of the compressed air.

The high-energy compressed air from the combustor section then flows into and through the turbine section, causing rotationally mounted turbine blades to rotate and generate energy. The air exiting the turbine section is exhausted from the engine via the exhaust section, and the energy remaining in this exhaust air aids the thrust generated by the air flowing through the bypass plenum.

The exhaust air exiting the engine may include varying levels of one or more pollutants. For example, the exhaust air may include, at varying levels, certain oxides of nitrogen ($NO_x$), carbon monoxide (CO), unburned hydrocarbons (UHC), and smoke. In recent years, environmental concerns have placed an increased emphasis on reducing these, and other, exhaust gas emissions from gas turbine engines. In some instances, emission-based landing fees are imposed on aircraft that do not meet certain emission standards. As a result, engine ownership and operational costs can increase.

Hence, there is a need for a gas turbine engine that can operate with reduced levels of exhaust gas emissions and/or that can reduce the likelihood of an owner being charged an emission-based landing fee and/or can reduce ownership and operational costs.

SUMMARY OF THE INVENTION

The present invention provides a gas turbine engine that includes a combustor that is configured to provide reduced exhaust gas emissions during engine operations.

In one embodiment, and by way of example only, a gas turbine engine includes a compressor, a turbine, and an annular combustor. The compressor includes an inlet and a compressed air outlet. The turbine has at least an inlet. The annular combustor includes an inner annular liner, an outer annular liner, a dome assembly, a plurality of main fuel injector assemblies, and a plurality of pilot fuel injector assemblies. The inner annular liner has an upstream end and a downstream end. The outer annular liner has an upstream end and a downstream end, and is spaced apart from, and at least partially surrounds, the inner annular liner. The annular dome assembly is coupled between the upstream ends of the inner and outer annular liners to define a combustion chamber therebetween. The plurality of main fuel injector assemblies are coupled to the dome assembly in a substantially circular pattern having a first radius, and each main fuel injector assembly includes an outlet port having a first divergence angle. The plurality of pilot fuel injector assemblies are coupled to the dome assembly in a substantially circular pattern having a second radius. Each pilot fuel injector assembly is disposed between at least two main fuel injector assemblies, and each includes an outlet port having a second divergence angle.

In another exemplary embodiment, an annular combustor includes an inner annular liner, an outer annular liner, a dome assembly, a plurality of main fuel injector assemblies, and a plurality of pilot fuel injector assemblies. The inner annular liner has an upstream end and a downstream end. The outer annular liner has an upstream end and a downstream end, and is spaced apart from, and at least partially surrounds, the inner annular liner. The annular dome assembly is coupled between the upstream ends of the inner and outer annular liners to define a combustion chamber therebetween. The plurality of main fuel injector assemblies are coupled to the dome assembly in a substantially circular pattern having a first radius, and each main fuel injector assembly includes an outlet port having a first divergence angle. The plurality of pilot fuel injector assemblies are coupled to the dome assembly in a substantially circular pattern having a second radius. Each pilot fuel injector assembly is disposed between at least two main fuel injector assemblies, and each includes an outlet port having a second divergence angle.

Other independent features and advantages of the preferred gas turbine engine combustor will become apparent from the following detailed description, taken in conjunction with the accompanying drawings which illustrate, by way of example, the principles of the invention.

DETAILED DESCRIPTION OF A PREFERRED EMBODIMENT

Before proceeding with the detailed description, it is to be appreciated that the described embodiment is not limited to use in conjunction with a particular type of turbine engine. Thus, although the present embodiment is, for convenience of explanation, depicted and described as being implemented in a multi-spool turbofan gas turbine jet engine, it will be appreciated that it can be implemented in various other types of turbines, and in various other systems and environments.

Figure 1:
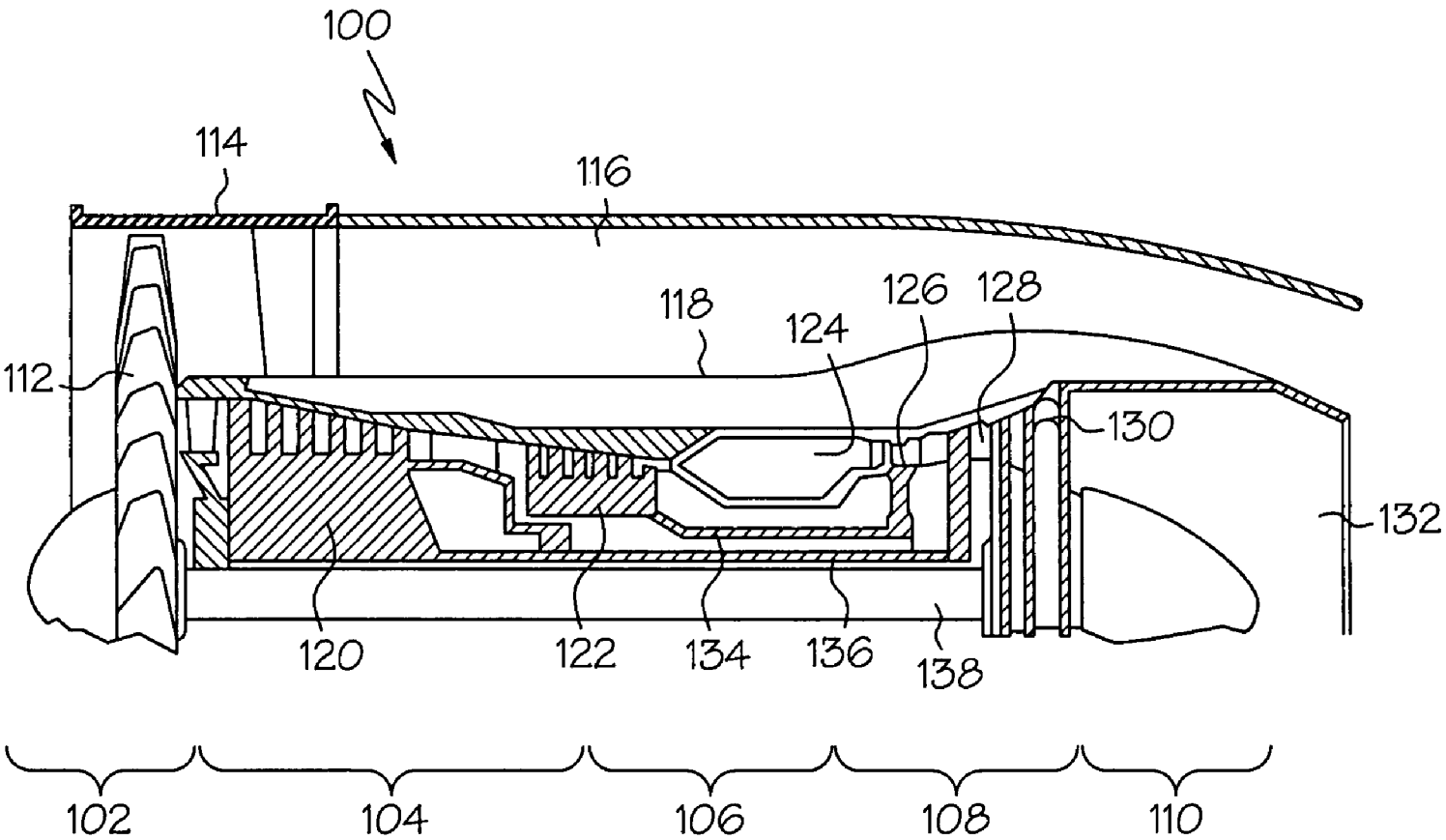
FIG. 1 is a simplified cross section side view of an exemplary multi-spool turbofan gas turbine jet engine according to an embodiment of the present invention.

An exemplary embodiment of a multi-spool turbofan gas turbine jet engine 100 is depicted in FIG. 1, and includes an intake section 102, a compressor section 104, a combustion section 106, a turbine section 108, and an exhaust section 110. The intake section 102 includes a fan 112, which is mounted in a fan case 114. The fan 112 draws air into the intake section 102 and accelerates it. A fraction of the accelerated air exhausted from the fan 112 is directed through a bypass section 116 disposed between the fan case 114 and an engine cowl 118, and provides a forward thrust. The remaining fraction of air exhausted from the fan 112 is directed into the compressor section 104.

The compressor section 104 includes two compressors, an intermediate pressure compressor 120, and a high pressure compressor 122. The intermediate pressure compressor 120 raises the pressure of the air directed into it from the fan 112, and directs the compressed air into the high pressure compressor 122. The high pressure compressor 122 compresses the air still further, and directs the high pressure air into the combustion section 106. In the combustion section 106, which includes an annular combustor 124, the high pressure air is mixed with fuel and combusted. The combusted air is then directed into the turbine section 108.

The turbine section 108 includes three turbines disposed in axial flow series, a high pressure turbine 126, an intermediate pressure turbine 128, and a low pressure turbine 130. The combusted air from the combustion section 106 expands through each turbine, causing it to rotate. The air is then exhausted through a propulsion nozzle 132 disposed in the exhaust section 110, providing addition forward thrust. As the turbines rotate, each drives equipment in the engine 100 via concentrically disposed shafts or spools. Specifically, the high pressure turbine 126 drives the high pressure compressor 122 via a high pressure spool 134, the intermediate pressure turbine 128 drives the intermediate pressure compressor 120 via an intermediate pressure spool 136, and the low pressure turbine 130 drives the fan 112 via a low pressure spool 138.

Figure 2:
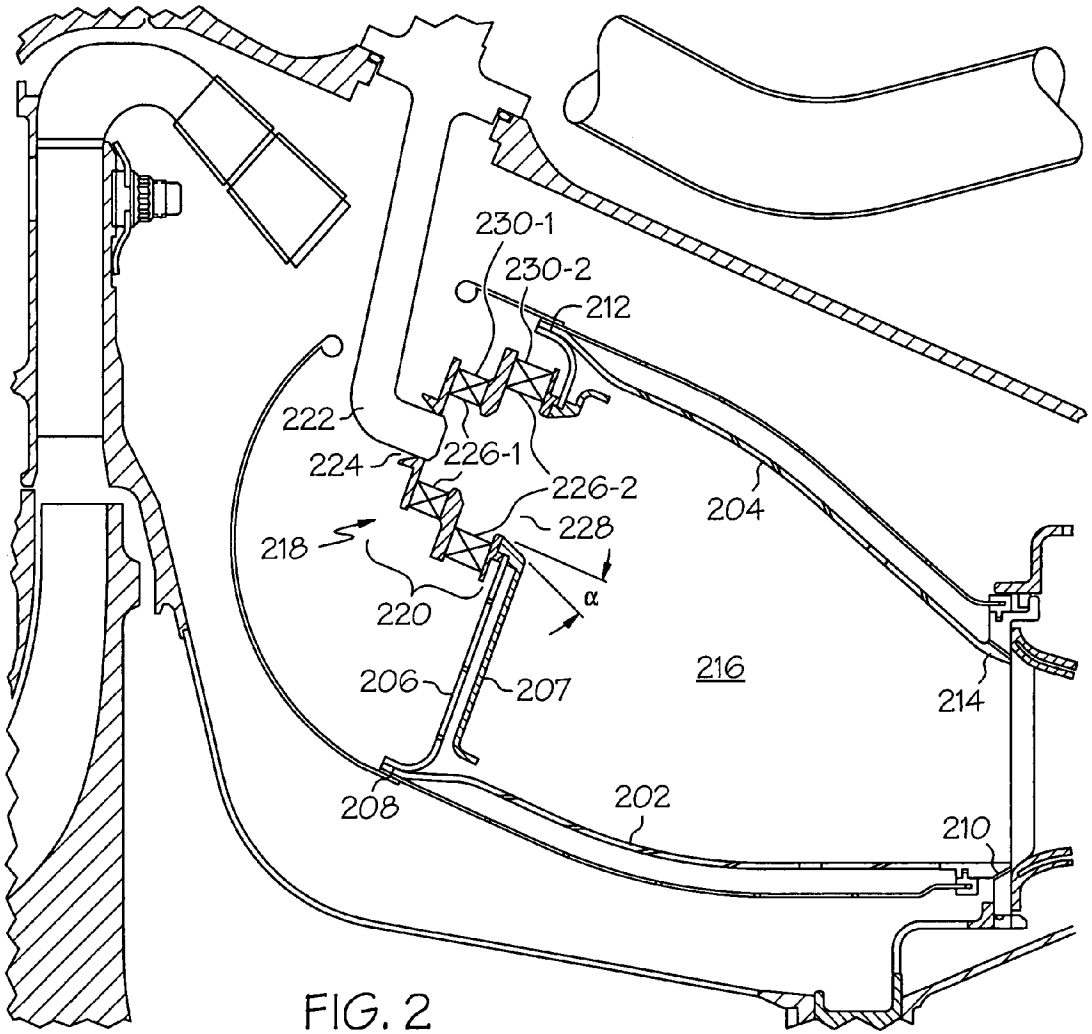
FIGS. 2 and 3 are cross section views of a portion of an exemplary combustor that may be used in the engine of FIG. 1, and that show, respectively, a main fuel injector and pilot fuel injector assembly.
Figure 3:
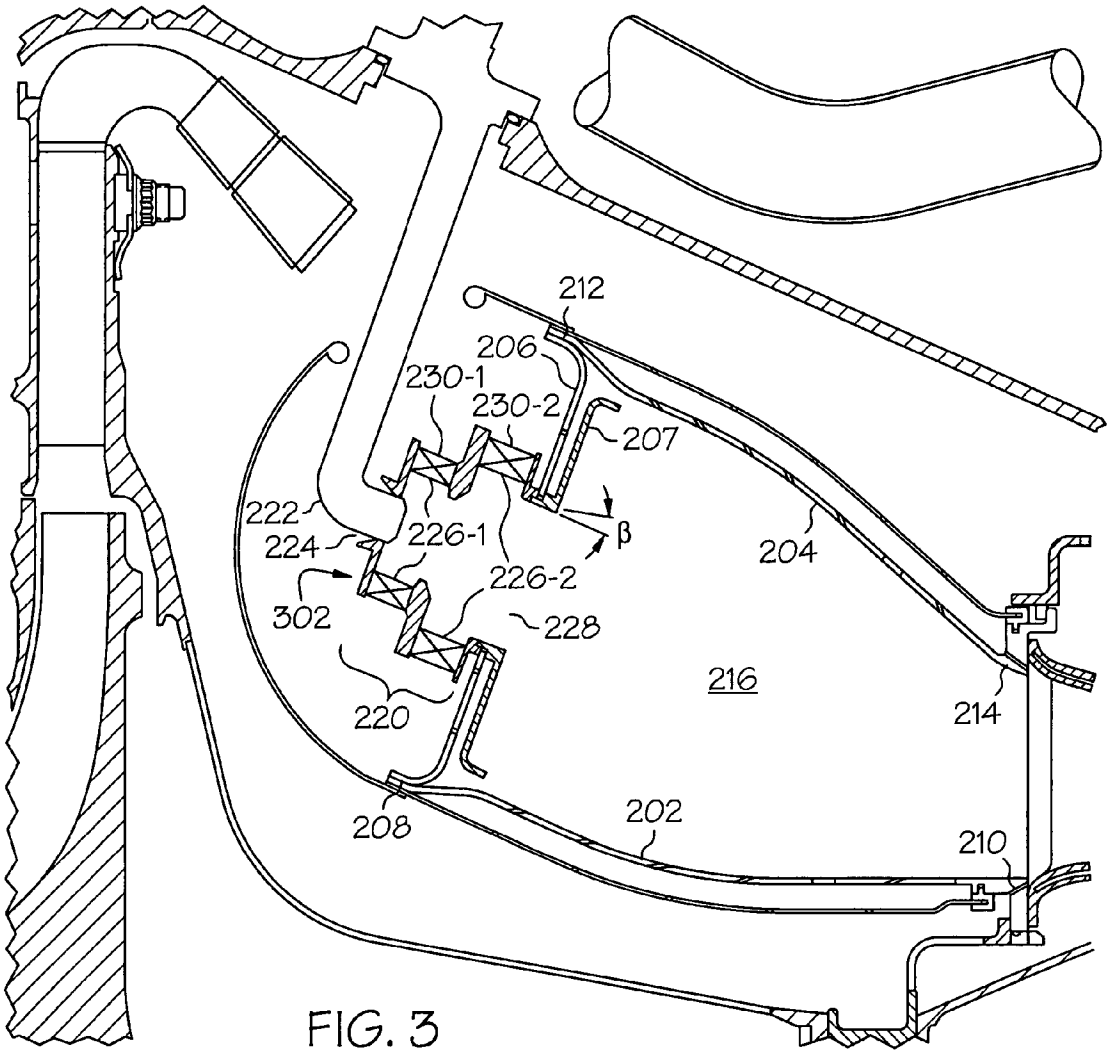

Turning now to FIGS. 2 and 3, it is seen that the annular combustor 124 includes an inner annular liner 202, an outer annular liner 204, and a combustor dome 206. The inner annular liner 202 includes an upstream end 208 and a downstream end 210. Similarly, the outer annular liner 204, which surrounds the inner annular liner 202, includes an upstream end 212 and a downstream end 214. The combustor dome 206 is coupled between the upstream ends 208 and 212 of the inner 202 and outer 204 annular liners, respectively, forming a combustion chamber 216 between the inner 202 and outer 204 liners. In the depicted embodiment, a heat shield 207 is coupled to the combustor dome 206, though it will be appreciated that the heat shield 207 could be eliminated. It will additionally be appreciated that although the inner 202 and outer 204 annular liners in the depicted embodiment are of a double-walled construction, the liners 202, 204 could also be a single-walled construction.

As FIGS. 2 and 3 additionally show, a plurality of fuel injector assemblies are coupled to the combustor dome 206. In particular, two types of fuel injector assemblies are coupled to the combustor dome 206—pilot fuel injector assemblies 218 (see FIG. 2) and main fuel injector assemblies 302 (see FIG. 3). It will be appreciated that, for clarity, only one fuel injector assembly type is shown in each of FIGS. 2 and 3. The pilot fuel injector assemblies 218, as is generally known, are typically used during combustor ignition and at low power operations, while the main fuel injector assemblies 302 are not. However, as engine power is increased, fuel is partially diverted away from the pilot fuel injector assemblies 218 and supplied in ever increasing amounts to the main fuel injector assemblies 302.

The pilot fuel injector assemblies 218 and the main fuel injector assemblies 302 each include a swirler assembly 220 and a fuel injector 222. The swirler assembly 220 includes a fuel inlet port 224, a pair of air inlet ports 226 (e.g., 226-1, 226-2), and a fuel/air outlet port 228. The fuel injector 222 is mounted within the fuel inlet port 224 and is in fluid communication with a non-illustrated fuel source. The fuel injector 222, as is generally known, supplies a spray of fuel into the swirler assembly 220. As will be described more fully below, the spray of fuel is mixed with air in the swirler assembly 220 to form a fuel/air mixture. The fuel/air mixture is in turn supplied to the combustion chamber 216, where it is ignited by one or more non-illustrated igniters. In the depicted embodiment, the fuel injector 222 in each of the pilot 218 and main 302 fuel injector assemblies are the same. It will be appreciated, however, that the fuel injectors 222 used in the pilot 218 and main 302 fuel injector assemblies could be different.

The air inlet ports 226, which are referred to herein as the primary air inlet port 226-1 and the secondary air inlet port 226-2, are each in fluid communication with the compressor section 104 and receive a flow of the compressed air supplied from the compressor section 104. A primary swirler 230-1 is disposed within the primary air inlet port 226-1, and a secondary swirler 230-2 is disposed within the secondary air inlet port 226-2. The swirlers 230 are configured to shape the compressed air that flows into the respective air inlet ports 226 into a generally circular flow pattern to, among other things, assist in rapidly mixing the fuel and air to improve combustion of the fuel/air mixture upon exit from the fuel/air outlet port 228.

Although the swirlers 230 could be any one of numerous types of swirlers, in a particular preferred embodiment, each is a radial swirler. It will additionally be appreciated that the primary 230-1 and secondary 230-2 swirlers in the pilot 218 and main 302 fuel injector assemblies could be configured to supply the same or different degree of swirl to the air. Additionally, the primary 230-1 and secondary 230-2 swirlers in the pilot 218 and main 302 fuel injector assemblies could be configured to supply the same or different amounts of air. In a particular preferred embodiment, the primary 230-1 and secondary 230-2 swirlers in both the pilot 218 and main 302 fuel injector assemblies provide the same degree of swirl, which is preferably about 70°. However, the swirlers 230-1, 230-2 in the pilot fuel injector assemblies 218 are preferably configured to supply less air than the swirlers 230-1, 230-2 in the main fuel injector assemblies 302.

The fuel/air outlet port 228 also assists in shaping the flow of the fuel/air mixture that exits the fuel injector assembly 218 or 302 and enters the combustion chamber 216. In this regard, the fuel/air outlet port 228-1 of each pilot fuel injector assembly 218 is structurally different from the fuel/air outlet port 228-2 of each main fuel injector assembly 302. In particular, the divergence angles of the pilot fuel injector assembly fuel/air outlet port 228-1 and the main fuel injector assembly fuel/air outlet port 228-2 differ. More specifically, the divergence angle of the pilot fuel injector assembly fuel/air outlet port 228-1 is wider than that of the main fuel injector assembly fuel/air outlet port 228-2. The divergence angle ($\alpha$) of pilot fuel injector assembly fuel/air outlet port 228-1 is fairly wide, which facilitates the rapid radial expansion of the fuel/air mixture, thereby improving rapid light-around of pilot fuel/air mixtures during ignition. Conversely, the divergence angle ($\beta$) of the main fuel injector assembly fuel/air outlet port 228-2 is fairly narrow, and thus tends to create a more axially-directed flow of the fuel/air mixture and maintains adequate isolation of the main air flow from the pilot flow during low power operation. Although the divergence angles may vary, and may be selected to meet various operational, system, and/or design requirements, in a particular preferred embodiment, the divergence angle ($\alpha$) of each pilot fuel injector assembly fuel/air outlet port 228-1 is in the range of about 25° to about 45°, and the divergence angle ($\beta$) of the main fuel injector assembly fuel/air outlet port 228-2 is in the range of about 0° to about 25°.

In addition to being structurally different, the pilot 218 and main 302 fuel injector assemblies are coupled to the combustor dome 206 at different radial and circumferential locations. More specifically, and with reference now to FIG. 4, it is seen that the main 302 and pilot 218 fuel injector assemblies are each coupled to the combustor dome 206 in a substantially circular pattern, and are substantially evenly spaced apart from one another. However, the circular pattern in which the pilot fuel injector assemblies 218 are each coupled to the combustor dome 206 has a first radius 402, and the circular pattern in which the main fuel injector assemblies 302 are each coupled to the combustor dome 206 has a second radius 404. In the depicted embodiment, the first radius 402 is greater than the second radius 404, though it will be appreciated that the combustor 124 is not limited to this configuration.

In addition to being coupled to the combustor dome 206 at different radii, the main 302 and pilot 218 fuel injector assemblies are also coupled to the combustor dome 206 in an alternating arrangement along their respective radii. More specifically, the pilot fuel injector assemblies 218 are circumferentially interspersed among the main fuel injector assemblies 302, such that each pilot fuel injector assembly 218 is preferably disposed circumferentially between two main fuel injector assemblies 302, and vice-versa.

Figure 4:
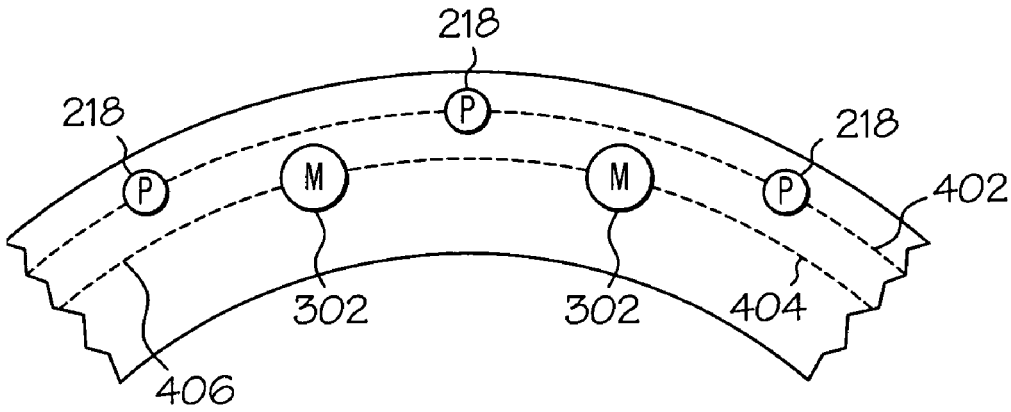
FIG. 4 is a partial end view of a portion of the combustor shown in FIGS. 2 and 3, which depicts the layout of the main and pilot fuel injectors in the combustor in accordance with one embodiment.
Figure 5:
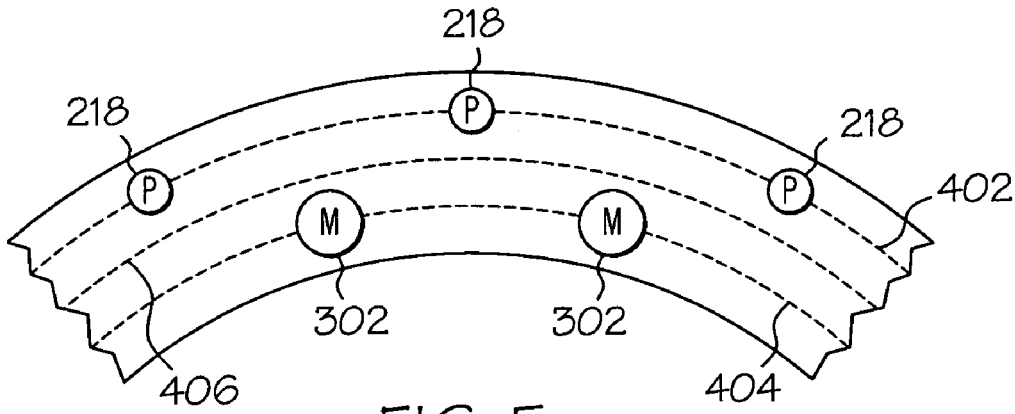
FIG. 5 is a partial end view of a portion of the combustor shown in FIGS. 2 and 3, which depicts the layout of the main and pilot fuel injectors in the combustor in accordance with an alternative embodiment.

In the embodiment depicted in FIG. 4, the second radius 404 is equivalent to a central radius 406 that is located substantially centrally between the upstream ends 208 and 212 of the inner 202 and outer 204 annular liners, respectively. Thus, the main fuel injector assemblies 302 are each centrally disposed in the combustion chamber 216 between the inner 202 and outer 204 liners. In an alternative embodiment, such as the one shown in FIG. 5, the second radius 404 is once again less than the first radius 402, but it is not equivalent to the central radius 406. Rather, the second radius 404 is less than the central radius 406. Thus, in the depicted alternative embodiment, the main fuel injector assemblies 302 are each disposed radially inwardly of the central radius 406, and the pilot fuel injector assemblies 218 are each disposed radially outwardly of the central radius 406.

The combustor configurations depicted and described herein reduce the amount of unwanted exhaust gas emissions. In particular, as was noted above, the pilot fuel injector assemblies 218 each include a fuel/air exit port 228 having a relatively wide divergence angle, and the main fuel injector assemblies 302 each include a fuel/air exit port 228 having a relatively narrow divergence angle. Moreover, the pilot 218 and main 302 fuel injectors are circumferentially interspersed. The wide divergence angle of the pilot fuel injector assemblies 218 facilitates fairly rapid radial expansion of the fuel/air mixture exiting the pilot fuel assemblies 218. The narrow divergence angle of the main fuel injector assemblies 302 creates a more axially-directed flow of the fuel/air mixture through the combustion chamber 216. As a result, the main combustion zone tends to be axially displaced, which provides for better isolation of the pilot fuel injector assemblies 218 at low power, while still providing sufficient interaction as power level increases. Moreover, the disclosed radial offsets of the pilots relative to the main, in combination with the disclosed divergence angles, facilitate strong pilot-to-pilot fuel injector assembly 218 interaction and light-around during combustor ignition. In addition, the pilot fuel injector assemblies 218 remain sufficiently decoupled from the main fuel injector assemblies 302 at low power levels, resulting in improved combustion efficiency and a reduced likelihood of CO and UHC quenching in the relatively cooler air flowing through the main fuel injector assemblies 302. The disclosed arrangement and structure also allows the combustor 124 to be operated as a fuel-staged combustor, while implementing relatively simple and less costly fuel injector and swirler components and configurations.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

We claim:

1. A gas turbine engine comprising:

a compressor having an inlet and a compressed air outlet;

a turbine having at least an inlet;

an annular combustor disposed between the compressor and the turbine, the annular combustor including:

an inner annular liner having an upstream end and a downstream end;

an outer annular liner having an upstream end and a downstream end, the outer annular liner spaced apart from, and at least partially surrounding, the inner annular liner;

a dome assembly coupled between the upstream ends of the inner and outer annular liners to define a combustion chamber therebetween;

a plurality of main fuel injector assemblies coupled to the dome assembly in a substantially circular pattern of a first radius, each main fuel injector assembly including an outlet port having a first divergence angle; and a plurality of pilot fuel injector assemblies coupled to the dome assembly in a substantially circular pattern of a second radius, each pilot fuel injector assembly disposed between at least two main fuel injectors, and each including an outlet port having a second divergence angle, wherein each of the main and pilot fuel injector assemblies comprise:

a swirler assembly having at least a fuel inlet port, a first air inlet port in fluid communication with the compressed air outlet, a second air inlet port in fluid communication with the compressed air outlet, and a fuel/air outlet port in fluid communication with the fuel inlet port, the first and second air inlet ports, and the combustion chamber, the fuel/air outlet port of each main and pilot fuel injector assembly swirler assembly is disposed such that when air is supplied to its first and second air inlet ports, the air supplied to its first and second air inlet ports is discharged from its fuel/air outlet port, and a fuel injector mounted at least partially within the fuel inlet port, and wherein:

the fuel/air outlet port of each main fuel injector assembly swirler assembly is configured with the first divergence angle, and the fuel/air outlet port of each pilot fuel injector assembly swirler assembly is configured with the second divergence angle, and the first divergence angle is non-zero and less than the second divergence angle.

2. The gas turbine engine of claim 1, wherein the first radius is located substantially centrally between the upstream ends of the inner and outer liners.

3. The gas turbine engine of claim 2, wherein the second radius is greater than the first radius.

4. The gas turbine engine of claim 1, wherein:

the first radius is less than a third radius of a circle that is centrally disposed between the upstream ends of the inner and outer liners; and the second radius is greater than the third radius.

5. The gas turbine engine of claim 1, wherein:

the first divergence angle is the range of about 0° to about 25°; and the second divergence angle is the range of about 25° to about 35°.

6. The gas turbine engine of claim 1, farther comprising:

a plurality of swirlers, each swirler disposed within one of the air inlet ports.

7. An annular combustor, comprising:

an inner annular liner having an upstream end and a downstream end;

an outer annular liner having an upstream end and a downstream end, the outer annular liner spaced apart from, and at least partially surrounding, the inner annular liner;

a dome assembly coupled between the upstream ends of the inner and outer annular liners to define a combustion chamber therebetween;

a plurality of main fuel injector assemblies coupled to the dome assembly in a substantially circular pattern of a first radius, each main fuel injector assembly including an outlet port having a first divergence angle; and a plurality of pilot fuel injector assemblies coupled to the dome assembly in a substantially circular pattern of a second radius, each pilot fuel injector assembly disposed between at least two main fuel injectors, and each including an outlet port having a second divergence angle, wherein each of the main and pilot fuel injector assemblies comprise:

a swirler assembly having at least a fuel inlet port, a first air inlet port in fluid communication with the compressed air outlet, a second air inlet port in fluid communication with the compressed air outlet, and a fuel/air outlet port in fluid communication with the fuel inlet port, the first and second air inlet ports, and the combustion chamber, the fuel/air outlet port of each main and pilot fuel injector assembly swirler assembly is disposed such that when air is supplied to its first and second air inlet ports, the air supplied to its first and second air inlet ports is discharged from its fuel/air outlet port, and a fuel injector mounted at least partially within the fuel inlet port, and wherein:

the fuel/air outlet port of each main fuel injector assembly swirler assembly is configured with the first divergence angle, and the fuel/air outlet port of each pilot fuel injector assembly swirler assembly is configured with the second divergence angle, and the first divergence angle is non-zero and less than the second divergence angle.

8. The annular combustor of claim 7, wherein the second radius is located substantially centrally between the upstream ends of the inner and outer liners.

9. The annular combustor of claim 8, wherein the first radius is greater than the second radius.

10. The annular combustor of claim 7, wherein:

the first radius is greater than a third radius of a circle that is centrally disposed between the upstream ends of the inner and outer liners; and the second radius is less than the third radius.

11. The annular combustor of claim 7, wherein:

the first divergence angle is the range of about 0° to about 25°; and the second divergence angle is the range of about 25° to about 35°.

12. The annular combustor of claim 7 further comprising:

a plurality of swirlers, each swirler disposed within one of the air inlet ports.

* * * * *

UNITED STATES PATENT AND TRADEMARK OFFICE

CERTIFICATE OF CORRECTION

PATENT NO. : 7,506,511 B2
APPLICATION NO. : 10/746654
DATED : March 24, 2009
INVENTOR(S) : Frank J. Zupanc et al.

It is certified that error appears in the above-identified patent and that said Letters Patent is hereby corrected as shown below:

Column 7, line 47, “farther” should be changed to --further--.

Signed and Sealed this

Twenty-third Day of June, 2009

JOHN DOLL
*Acting Director of the United States Patent and Trademark Office*